United States Patent [19]

Brocklehurst

[11] Patent Number: 4,505,467

[45] Date of Patent: Mar. 19, 1985

[54] LABEL DISPENSER WITH SUCTION HOLD AND FORK MEMBER RELEASE

[75] Inventor: Charles E. Brocklehurst, Fountain Inn, S.C.

[73] Assignee: Opelika Manufacturing Corporation, Chicago, Ill.

[21] Appl. No.: 519,483

[22] Filed: Aug. 1, 1983

[51] Int. Cl.[3] ..... B42B 1/02

[52] U.S. Cl. ..... 270/53; 271/11; 271/31.1; 271/149; 156/DIG. 31; 156/DIG. 38

[58] Field of Search ..... 270/53; 271/8 A, 11, 271/30 A; 156/DIG. 1, DIG. 31, DIG. 37, DIG. 38, 230, 285, 297

[56] References Cited

U.S. PATENT DOCUMENTS

| | | | |
|---|---|---|---|
| 2,349,063 | 5/1944 | Von Hofe | 271/11 |
| 3,621,801 | 11/1971 | Huddleston | 112/262 |
| 3,767,185 | 10/1973 | Newsome | 271/11 |
| 4,097,040 | 6/1978 | Pugh et al. | 271/30 A |
| 4,157,692 | 6/1979 | Brocklehurst et al. | 112/262.3 |
| 4,191,607 | 3/1980 | Cope | 156/384 |
| 4,255,220 | 3/1981 | Kuchecu et al. | 156/DIG. 38 |
| 4,265,695 | 5/1981 | Hurley et al. | 156/285 |
| 4,288,280 | 9/1981 | Morin | 156/510 |
| 4,289,562 | 9/1981 | Chisolm | 156/DIG. 31 |
| 4,293,365 | 10/1981 | Geyser et al. | 156/364 |
| 4,367,118 | 1/1983 | Karp | 156/497 |
| 4,369,962 | 1/1983 | Spiro | 271/11 |
| 4,380,331 | 4/1983 | Fischer | 271/11 |
| 4,390,386 | 6/1983 | Bartl | 156/DIG. 38 |
| 4,402,497 | 9/1983 | Weibel et al. | 271/11 |
| 4,456,241 | 6/1984 | Newsome | 271/11 |

*Primary Examiner*—E. H. Eickholt

*Attorney, Agent, or Firm*—Thomas & Kennedy

[57] ABSTRACT

Labels 36 are arranged in a stack and supported in a tray 11, and the open end 49 of a suction tube 46 is reciprocated toward and away from the label at the end of the stack, to draw the end label away from the stack. A fork member 12 straddles the suction tube and reciprocates about the suction tube so as to engage the label on opposite sides of the tube and push the label off the tube, thereby dropping the label into an inclined chute 72. A conveyor belt 85 positioned in the inclined chute moves the label downwardly toward engagement with the moving work product 14, and the lower conveyor roller 81 presses the label into position on the work piece and a band 90 extends about the lower conveyor roller and extends toward the sewing machine 20 to hold the label in place as it advances to the sewing machine.

17 Claims, 9 Drawing Figures

LABEL DISPENSER WITH SUCTION HOLD AND FORK MEMBER RELEASE

BACKGROUND OF THE INVENTION

This invention relates to a label dispensing system which functions to retrieve the end label in a stack of labels and to move the label to a moving work piece, such as to a moving terry cloth towel which is about to have its cut edge folded over and sewn into a hem. The label is inserted into the hem before the stitching is formed in the hem.

It is customary to insert labels and the like in the hemmed edge of towels and of other manufactured products, and to sew the label into the hem. The hem can be folded over the label, or the edge of the product can have an overedge stitch which also attaches the label to the product. In the past, hemmed edges of towels and other products were formed by hand, with a sewing machine operator guiding the edge of the work piece through a folder and toward a sewing machine to fold the edge portion and to sew the fold closed. Labels were inserted by the operator into the hem as the hem was being formed and sewn closed.

More recently, automatic hemming systems have been developed which automatically hem the edges of sheet material. Examples of such automatic systems are shown in U.S. Pat. Nos. 3,773,002 and 3,906,878.

An example of a label dispenser which can be utilized to dispense a label to the hem of a towel, sheet or the like as the hem is being formed is illustrated in U.S. Pat. No. 4,157,692.

The reliable placement of labels in the hem of sheet material is difficult to accomplish. The equipment occasionally fails to dispense a label, the labels which are dispensed sometimes are not properly positioned on the work piece, and sometimes more than one label is dispensed at a time. Usually, the labels are arranged in a vertical stack and supported in a housing or tray, and the bottom label is pulled from the stack and moved to the work piece. When the stack of labels contains a large number of labels, the weight applied to the bottom label will be more than when the stack has been substantially depleted. This means that more force is required to remove the bottom label from a large stack than to remove the bottom label from a short stack. If too little force is applied to the bottom label of a large stack, it is likely that the label will not separate from the stack; however, if the removal force is increased and the stack depletes, it is more likely that the additional force applied to the bottom label in a short stack will withdraw more than one label from the stack at a time. Moreover, the weight applied to the bottom label in a stack tends to compact the labels so that if a suction device is applied to the bottom label to pull the label from the stack, the compact condition of the labels is likely to require a substantial amount of air suction to be applied to a label to withdraw the label from the stack, yet the increase in suction may tend to cause more than one label to be affected by the flow of air to the suction device, thereby pulling more than one label from the stack.

When the type of label being handled by a label dispenser is changed to a label that is stiffer or more limber, or to a label that is thicker or thinner than a previous label, the air suction utilized to draw the label away from the vertical stack usually must be modified so as to be compatible with the particular labels being dispensed.

SUMMARY OF THE INVENTION

Briefly described, the present invention comprises a label dispenser for dispensing labels from a stack of labels and placing each label on a work piece at a predetermined position adjacent an edge of the work piece, so that the label can be sewn into the hem of the work piece. The labels are stacked one against the other, and the stack is oriented in a slightly inclined attitute in a label support tray, so that a minor proportion of the weight of each label tends to induce the label to move down the incline of the tray to the end of the tray, where a suction tube is reciprocated toward and away from the end label, to draw the end label away from the stack. A fork member straddles the suction tube and reciprocates about the suction tube so as to wipe the label off the end of the suction tube, whereupon the label drops to an inclined chute. A belt conveyor extends along the inclined chute and moves the label in timed relationship down the chute toward a moving work piece and presses the label against the work piece as the label reaches the lower end of the chute. A conveyor drive belt continues holding the label to the work piece as the label moves with the work piece away from the chute and as the hem is formed in the work piece over an edge of the label.

Thus, it is an object of this invention to provide a label dispenser system which reliably and accurately dispenses one label at a time to a work piece where the label can be sewn to the work piece.

Another object of this invention is to provide a label dispensing system which holds labels stacked one against the other in a slightly inclined attitude wherein only a small percentage of the weight of each label is applied to the label at the bottom of the stack, so that as the stack of labels is depleted during the dispensing function, the weight applied to the bottom label is not substantially changed.

Another object of this invention is to provide a label dispensing system that is inexpensive to construct and to maintain, which is simple to understood and to operate, and which functions to withdraw one label at a time from a supply of labels and to firmly apply each label in a predetermined position on a work product and to hold the label in position as the label moves with the work product toward a sewing station.

Other objects, features and advantages of the present invention will become apparent upon reading the following specification, when taken in conjunction with the accompanying drawings.

DETAILED DESCRIPTION

Figure 1:
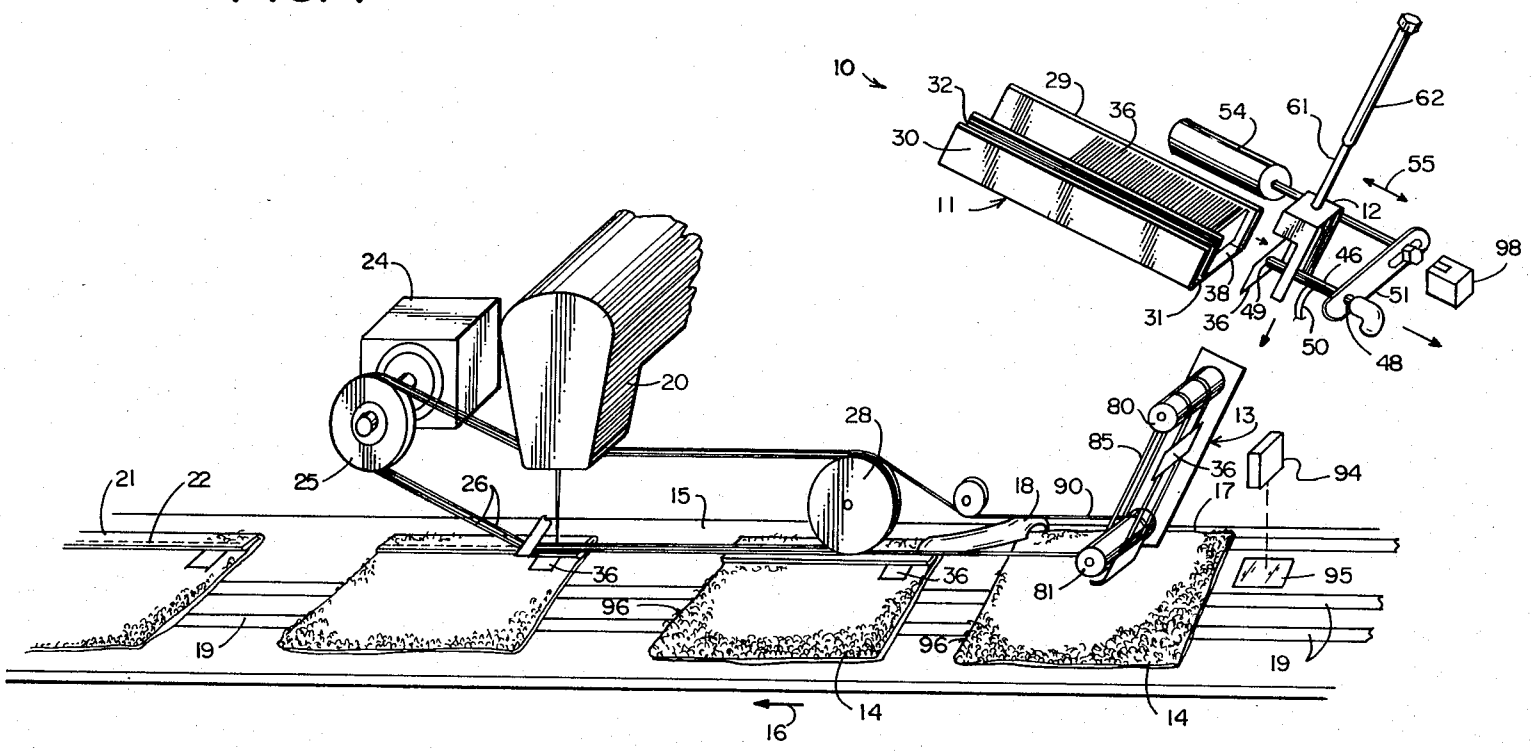
FIG. 1 is a schematic perspective illustration of the label dispenser, showing how labels are dispensed one at a time from a stack of labels to a work product, and then are carried to the needle of a sewing machine.

Referring now in more detail to the drawings, wherein like numerals indicate like parts throughout the several views, FIG. 1 illustrates, in schematic form, the label dispenser 10 which includes a label support tray 11, a fork member 12, and delivery chute assembly 13. The delivery chute assembly 13 is positioned over a work surface 15, and a plurality of work pieces 14 are moved across the work surface 15 in sequence by surface conveyor belts 19. In the embodiment herein illustrated, the work pieces are terry cloth towels which have been cut from a length of material, with the cut edges 17 extending parallel to the direction of movement 16 across the work table. The cut edges 17 move through a folder 18 of the type illustrated in U.S. Pat. No. 3,906,878, whereby one or two folds are formed at the cut edge portion of the towel, thereby forming a hem. The hem is guided by the conveyor bands 26 to a sewing machine 20 where the hem 21 is sewn with the stitching 22 in a closed configuration. The gear box 24 rotates its sheave 25 so that bands 26 extending about sheave 25 and sheave 28 engage the folded cut edge of the towels 14 and advance the folded portion of the towel to the sewing machine 20.

Figure 2:
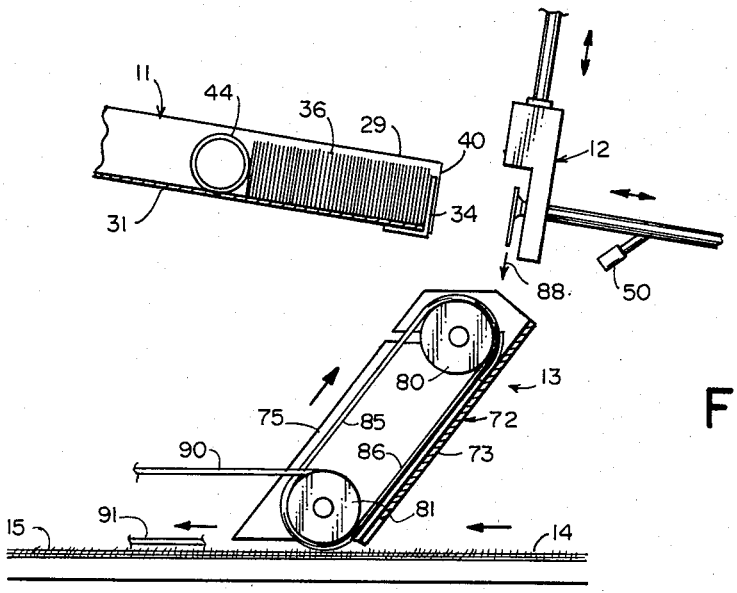
FIG. 2 is a schematic side elevational view, with parts broken away, of the label dispenser, showing the label support tray, the suction tube, the fork member, and the inclined chute.
Figure 3:
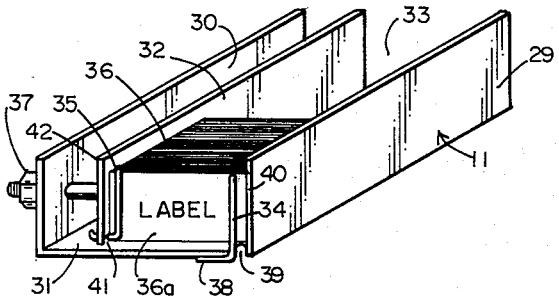
FIG. 3 is a perspective illustration of the label support tray.

As illustrated in FIGS. 2 and 3, the label support tray 11 comprises a channel-shaped member including spaced, parallel side walls 29 and 30 and bottom wall 31. Movable partition 32 is supported between and parallel to side walls 29 and 30 by means of adjustable bolts 37. With this arrangement, the partition 32 can be moved within the confines of the support tray to form a space 33 between side wall 29 and partition 32 that accommodates labels 36 of different widths. Label end support stanchions 34 and 35 are located at the lower end or delivery end 38 of the label support tray, with support stanchion 34 being mounted to the bottom surface of bottom wall 31 and extending upwardly through notch 39 of the bottom wall so that it is parallel and offset inwardly of the delivery edge 40 of support tray side wall 29. The other label end support stanchion 35 is mounted to the outer surface of partition 32 and extends through a notch 41 of the partition and projects upwardly and is spaced from and is parallel to the delivery edge 42 of partition 32. When a plurality of labels 36 are stacked one against the other and are moved down the incline of label support tray 11, the end label 36A will engage stanchions 34 and 35 adjacent its ends (FIG. 4), but the center portion of the label intermediate its side edges is free.

As illustrated in FIG. 2, the label support tray 11 is inclined at a shallow angle, between 10° and 20°, just enough for a cylindrical roller 44 or other round object to roll down the incline of the tray behind a stack of labels 36. The incline of the tray is not sufficient for the labels themselves to move down to the delivery end of the tray, but the weight of the roller is such that the labels are continuously urged by the roller toward engagement with the label end support stanchions 34 and 35. The label support tray is adjustable in that its angle of incline can be varied to permit more weight of the roller 44 to be applied to the labels, if necessary.

As illustrated in FIG. 1, suction conduit 46 is positioned adjacent the delivery end 38 of label support tray 11. Suction conduit 46 is an open-ended tube having an exhaust end opening 48 and a suction end opening 49, and a branch conduit 50 intersects the suction conduit 46 intermediate its ends to supply a stream of air at an angle through the conduit directed toward the exhaust end opening 48. This tends to induce a zone of reduced air pressure, and therefore a flow of air into the suction end opening 49 of the suction conduit 46.

Figure 4:
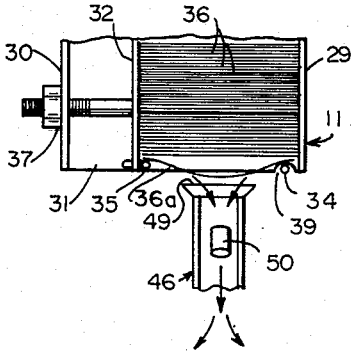
FIG. 4 is a plan view of a portion of the label support tray, showing the suction tube applied to the end label in the stack of labels supported by the support tray.

Suction conduit 46 is mounted to bracket 51. Bracket 51 is mounted to the cylinder rod 52 of cylinder 54, with cylinder 54, bracket 51 and suction conduit 46 being arranged so that the cylinder reciprocates suction conduit as indicated by arrow 55 toward and away from the labels stacked in the label support tray 11. The suction end opening 49 is movable toward and away from the end label at the delivery end 38 of the label support tray, and when the suction end 49 engages the end label 36A, the zone of reduced air pressure created at the suction end opening tends to draw air through the end label 36A, causing the end label to cling to the suction end opening 49 (FIG. 4). When the cylinder 54 distends its rod 52, the suction conduit 46 moves away from the stack of labels, and withdraws the end label 36A from the stack. As the end label withdraws from the stack, its side edges tends to be pulled out from behind stanchions 34 and 35 (FIG. 4), but the next adjacent label simply moves forward so that its end portions engage the stanchions, so that it remains in the stack of labels on the label support tray 11. As the suction conduit 46 continues to move away from the label support tray to a retracted position (FIGS. 1, 2 and 7), the label is then moved beneath the fork member 12.

Figure 8:
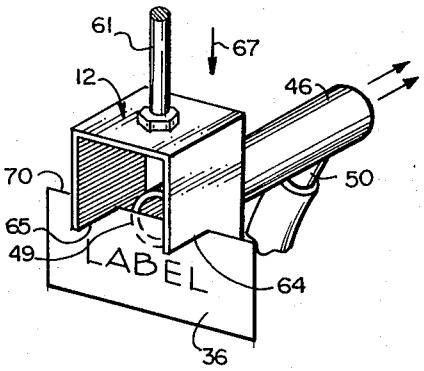
FIGS. 6, 7, 8 and 9 are progressive illustrations of the fork member and suction tube, showing the manner in which the suction tube first withdraws the end label from the stack of labels and moves the label to the fork member, and showing how the fork members urges each label off the end of the suction tube and drops the label to the inclined chute.
Figure 9:
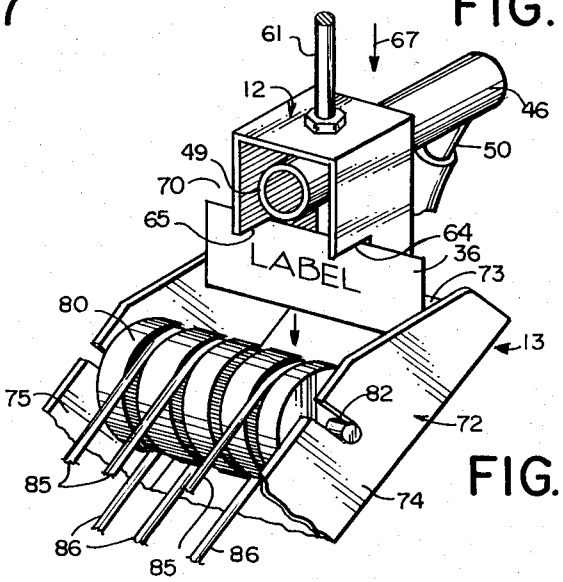

As illustrated in FIGS. 1, 2 and 6–9, fork member 12 includes a U-shaped bifurcated member including a base 58 and parallel side plates 59 and 60 depending downwardly from the base 58. The base 58 is mounted to the rod 61 of cylinder 62, while the side plates are positioned on opposite sides of and straddle the suction conduit 46. The side plates 59 and 60 are undercut to form downwardly-facing ledges 64 and 65 and vertical edges 68 and 69 extending downwardly below ledges 64 and 65. The ledges 64 and 65 are normally located at an elevation higher than suction conduit 46, higher than the position of a label 36 when a label has been attracted to and held by the suction end opening 49 of the suction conduit 46. When the cylinder 62 moves the fork member 12 downwardly as indicated by direction arrow 67, the downwardly-facing ledges 64 and 65 will move downwardly from above the suction conduit 46 to a level below the suction conduit (FIG. 9).

Figure 7:
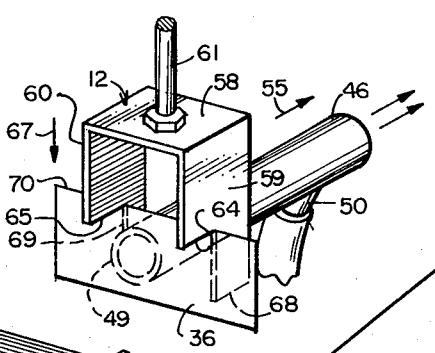
Figure 6:
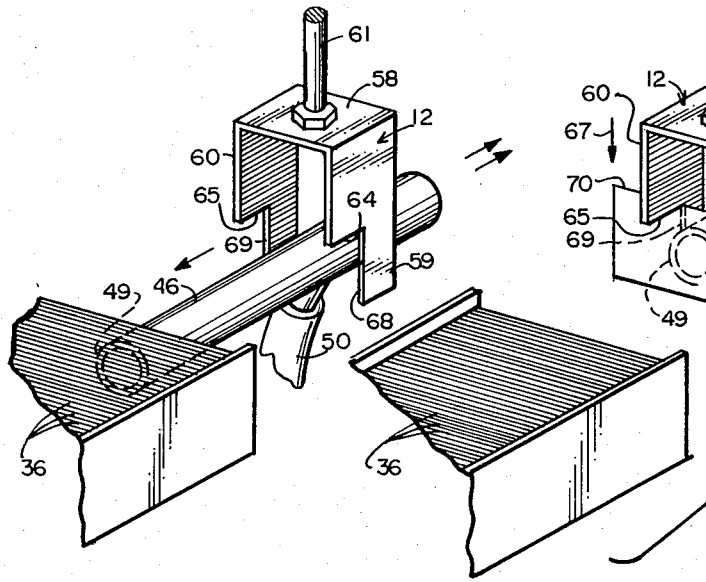

As illustrated in FIGS. 7, 8 and 9, a label label 36 which is clinging to the suction end opening 49 of the suction conduit will be positioned below the ledges 64 and 65, substantially in abutment with the vertical edges 68 and 69 of the side plates 59 and 60. When the cylinder 62 distends its rod 61 downwardly, the downwardly-facing ledges 64 and 65 will engage the upper edge 70 of the label at positions on opposite sides of the suction conduit 46, and urge the label downwardly (FIGS. 8 and 9) in a direction extending in the plane of the label, so that the label is wiped off the suction end opening 49 of the suction conduit 46. Because the label is engaged in two places along its upper edge 70 by the downwardly-facing ledges 64 and 65, the ledges tend to orient the label, thereby assuring that the upper edge 70 of the label is exactly oriented in a horizontal attitude. As the label uncovers the suction end opening 49 of the suction conduit 46, a substantial amount of the suction force applied to the label is depleted, and as the label continues to uncover the suction end opening, substantially all of the clinging force of the label is depleted, until the label is completely removed from in front of the suction opening (FIG. 9). Therefore, the label is gradually released by the suction conduit as it is wiped away from the suction conduit by fork member 12. In the meantime, the label is precisely oriented by the fork member and maintains its orientation as it moves downwardly until it drops away from the fork member.

As illustrated in FIGS. 1, 2 and 9, the labels 36 are dropped by the fork member 12 to the upper end of delivery chute assembly 13. Delivery chute assembly 13 includes an inclined chute or tray 72 that includes a base or lower wall segment 73 and parallel sidewalls 74 and 75. A plurality of slots 76 are formed in the base wall segment 73 of the tray at the upper end portion of the tray, while a plurality of open-ended slots 77 are formed in the base wall segment 73 at the lower end of the tray. Conveyor belt means 79 is positioned in the inclined tray 72 and comprises a first conveyor roll 80 positioned at the upper end portion of tray 72 and a second conveyor roll 81 positioned at the lower end portion of the tray. Each coveyor roll 80 and 81 is substantially cylindrical and is mounted to rotate about an axis 82 attached at its ends to the side walls 74 and 75 of the tray. The convex peripheral surface of the conveyor rolls 80 and 81 have formed therein annular grooves 84, with the grooves 84 of the coveyor rolls being aligned with the slots 76 and 77 of the conveyor tray 72. Conveyor bands 85 extend about the first and second conveyor rolls, with the bands 85 being received in aligned ones of the annular grooves 84 of the conveyor rolls. Two or more bands 85 extend about the conveyor rolls. When narrow labels are being handled by the system, the conveyor bands 85 may be positioned closely adjacent one another in the annular grooves 84, or the bands 85 may be spread further apart and received in other ones of the annular grooves when larger labels are being handled. The portions of the conveyor bands extending about the first and second conveyor rolls are aligned with the slots 76 and 77, so that the inner flight 86 of the conveyor bands will move first through a slot 76, then emerge out of a slot 76 and move in juxtaposition across the base wall segment 73 to the second conveyor roll 81, where it will then move through a slot 77 as it moves about the lower conveyor roll 81.

As illustrated in FIGS. 2 and 9, the labels 36 are dropped from the fork member 12 as indicated by direction arrow 88 to the base wall segment 73 of the inclined conveyor tray 72, beneath the conveyor roll 80. When the label is received on the surface of the base wall segment 73, it tends to be guided by the base wall segment toward engagement with the conveyor bands 85 without being reoriented. The conveyor bands make contact with the label, urging the label into engagement with the base wall segment 73 of the conveyor tray 72, and holding the label in contact with the base wall segment as the bands drag the label down the inclined conveyor tray 72 toward the work product 14.

The lower or second conveyor roll 81 engages the work product 14 and tends to rotate on the work product. When a label has been moved by the conveyor bands 85 to the lower conveyor roll 81, the lower conveyor roll and the bands 85 tend to press the label against the surface of the work piece 14. The label changes directions from the inclined attitude of the base wall segment 73 of the inclined conveyor tray 72 to the horizontal attitude of the work piece 14 as the label moves about the lower portion of the lower or second conveyor roll 81. When the conveyor bands 85 are moved on their return flight back to the upper or first conveyor roll 80, the label is left in a static position on the work piece 14, and moves with the work piece on toward the sewing machine 20.

Figure 5:
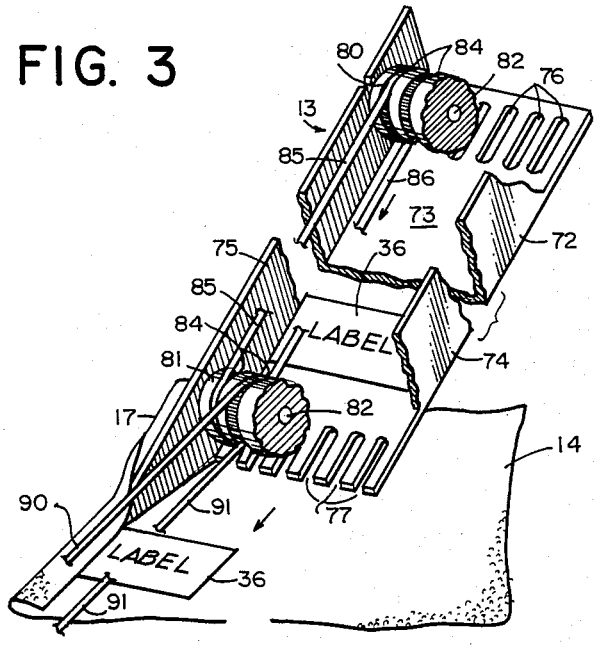
FIG. 5 is a perspective illustration of the inclined chute and conveyor belt assembly, with parts broken away, showing how a label is moved down the chute toward a work product and held to the work product as the work product moves away from the chute.

As illustrated in FIGS. 1, 2 and 5, the sheave 28 of the folding mechanism also drives drive band 90 which extends about second or lower conveyor roll 81, fitting into one of the grooves 84 of the second conveyor roll. Thus, the second conveyor roll is rotated by the sheave 28 and drive band 90, with the lower flight 91 of the drive band emerging out from beneath the lower or second conveyor roll 81 and moving in contact with the work piece 14 and the label 36 toward the sewing machine 20. With this arrangement, the drive band 90 rotates the lower or second conveyor roll 81, and the conveyor bands 85 extending between the lower conveyor roll 81 and the upper or first conveyor roll 80 rotate the upper conveyor roll 80. Thus, the inner flights 86 of the conveyor bands 85 move at the same linear velocity as the drive band 90, so that the label is moved at the same velocity down the incline of the conveyor tray 72 and then along the work table on the work piece 14. The lower flight 91 of the drive band 90 tends to stabilize the label 36 as it moves with the work piece, and as the cut edge 15 of the work piece is folded over (FIG. 5). When the lower flight 91 of the drive band 90 is picked up by the sheave 28, the lower flights of the other bands 26 of the folder will be placed down upon the label 36 and will continue to carry the label to the sewing machine. The lower flight 91 of the drive band 90 assures that the label 36 will not tend to cling to the conveyor bands 85 as the labels are pressed against the work piece 14.

As illustrated in FIG. 1, a photoelectric cell 94 is suspended over a reflective surface 95 and functions as a detecting means to detect the oncoming or leading edge 96 of a work piece 14. When the detection is made by the photoelectric cell 94, a control circuit (not shown) is actuated which causes the label dispenser to cycle. Cylinder 54 is actuated to retract suction conduit 46 toward the stacked labels 36 in label support tray 11 so that the suction end opening 49 of the suction conduit 46 engages the end label 36A (FIG. 4). At the same time, a stream of air is directed through branch conduit 50, causing a stream of air to be directed through suction conduit 46 and inducing a zone of reduced air pressure at the suction end opening 49 of the suction conduit, and expelling air through the exhaust end opening 48. When the open end of the suction conduit 46 is applied to the end label 36A, the label tends to cling to the suction conduit.

When the suction conduit has been moved to the position in abutment with the end label of the label support tray 11, the movement of the suction conduit 46 depresses a switch (not shown) which reverses the direction of movement of the cylinder 54, causing the suction conduit to be moved away from the label support tray 11. This tends to pick the end label 36A off the stacked labels 36, and bring the label with the suction conduit to a displaced position over the conveyor tray 72. When the suction conduit reaches its displaced position it actuates another switch 98 in the control system, which terminates the flow of air through branch conduit 50 and causes fork member 12 to be moved downwardly by its pneumatic cylinder 62, whereupon the label is engaged by the fork member and is moved off the suction end opening of the suction conduit down to the delivery chute assembly 13, so that the conveyor bands 85 move the labels down the incline of the chute and apply the label to the work piece 14. This completes the cycle of the control circuit.

In the meantime, the first and second conveyor rolls 80 and 81 rotate in response to the operation of the sewing machine 20. Therefore, the label received in the delivery chute assembly 13 will move at a velocity toward the work piece that corresponds to the velocity of the work piece across the work table. When the label reaches the lower end of the delivery chute assembly 13, the drive band 90 tends to guide the label away from the second conveyor roll 81 and hold the label in a fixed position on the surface of the work piece 14 as the label approaches the sewing machine 20.

While this invention has been disclosed as a label dispenser, it should be obvious that various other items can be dispensed by the apparatus and method disclosed herein. Moreover, while the work piece has been identified as a terry cloth towel, obviously other type work pieces can be handled by the system.

While this invention has been described in detail with particular reference to a preferred embodiment thereof, it will be understood that variations and modifications can be effected within the spirit and scope of the invention as described hereinbefore and as defined in the appended claims.

I claim:

1. A method of dispensing labels and the like from the end of a stack of labels to a work product comprising applying the opening of a conduit to one surface of the end label in the stack, drawing suction in the conduit, moving the conduit away from the stack so that the end label clings to the opening of the conduit and moves with the conduit away from the stack, urging the label clinging to the conduit in a direction approximately parallel to the plane of the label off the opening of the conduit, and moving the label from the opening of the conduit to the work product.

2. The method of dispensing labels as set forth in claim 1 and wherein the step of applying the opening of a conduit to one surface of the end label in the stack and moving the conduit away from the stack comprises reciprocating a conduit with an open end toward and away from the stack so that the open end of the conduit engages and moves away from the stack, and wherein the step of urging the label clinging to the conduit off the opening of the conduit comprises moving a bifurcated label engaging tool about the open end of the conduit and in a direction approximately parallel to the plane of the label into engagement with an edge of the label to push the label across the opening of the conduit.

3. The method of dispensing labels as set forth in claim 1 and wherein the step of moving the label to the work product comprises dropping the label from the opening of the conduit into the upper end portion of an inclined chute, moving conveyor belt means in contact with the labels and down the incline of the chute to carry the labels to a work product at the lower end of the chute.

4. The method of dispensing labels as set forth in claim 1 and wherein the step of drawing suction in the conduit comprises directing a stream of air in one direction along the length of and open-ended conduit toward one end opening of the conduit so as to induce a negative air pressure at the other end opening of the conduit.

5. A method of dispensing flat labels and the like from a stack of labels to a work product comprising the steps of reciprocating one open end portion of a conduit between a position of substantially flat abutment with the end label of a stack of labels and a position displaced from the stack of labels, creating a zone of reduced air pressure in the conduit at its open end portion when the open end portion is in abutment with the stack of labels and as the conduit moves away from the stack of labels so that the end label in the stack of labels clings to the open end of the conduit and moves with the conduit away from the stack of labels, moving a bifurcated label engaging tool about the open end portion of the conduit in a direction extending approximately in the plane of the label so as to engage an edge portion of the label on opposite sides of the conduit and to push the label in a direction extending along its plane off the open end portion of the conduit, and moving the label from the open end portion of the conduit to a work product.

6. The method of dispensing labels as set forth in claim 5 and wherein the step of moving the label from the open end portion of the conduit to a work product comprises dropping the label to the upper end portion of an inclined chute, moving conveyor band means down the chute to carry the label down to chute to a work product.

7. The method of dispensing labels as set forth in claim 5 and further including the step of relieving the zone of reduced air pressure in the conduit as the label engaging tool moves about the open end portion of the conduit.

8. The method of dispensing labels as set forth in claim 5 and wherein the step of creating a zone of reduced air pressure in the conduit at its open end comprises directing a stream of air along the conduit away from the open end of the conduit.

9. Apparatus for dispensing labels and the like to a work product comprising a label tray for holding labels stacked one against the other in an inclined attitude, suction means movable toward and away from the lower end of the stack of labels held by the label tray for engaging the label at the lower end of the stack so that the label clings to the suction means and moving the label away from the stack, bifurcated label engaging means movable about said suction means against the label clinging to the suction means in a direction extending along the plane of the label to urge the label off the suction means, and means for receiving the label from the suction means and delivering the label to the work product.

10. The apparatus for dispensing labels of claim 9 and wherein said suction means comprises a conduit with an open end and means for directing a stream of air along the conduit away from the open end of the conduit to induce a zone of reduced air pressure at the open end of the conduit, and wherein said bifurcated label engaging means comprises a pair of substantially parallel plates straddling said conduit and each plate including a ledge movable from one side to the other side of said conduit for engaging and edge of the label extending on opposite sides of the conduit at the open end of the conduit and for urging the label off the open end of the conduit.

11. The apparatus for dispensing labels of claim 9 and wherein said suction means comprises a conduit with an open end and means for inducing a flow of air into the open end of said conduit whereby a label clings to the open end of said conduit, said bifurcated label engaging means including an approximately U-shaped label engaging fork with side plates straddling said conduit, said side plates each including a ledge movable from one side to the other side of the conduit for engaging an edge portion of a label and pushing the label in a direction approximately parallel to its plane off the open end of said conduit.

12. The apparatus for dispensing labels of claim 9 and wherein said means for receiving the label from said suction means comprises an inclined chute, conveyor belt means extending along said chute for moving labels down the inclined chute to the work product.

13. The apparatus of claim 12 and further including detecting means for determining when a work product moves beneath said inclined chute, control means responsive to said detecting means for reciprocating said suction means to withdraw a label from the stack of labels and for moving said label engaging means about said suction means to urge the label off said suction means so that the label drops to said chute.

14. The apparatus for dispensing labels of claim 13 and further including means for moving said conveyor belt means in timed relationship with the work product.

15. Apparatus for dispensing flat labels and the like from a stack of labels to a work product comprising a label support tray for supporting a plurality of substantially flat labels stacked flat one against the other and with one end of the stack positioned at one end of the tray, a suction tube including an open end, air flow means for forming a zone of reduced air pressure within said suction tube at said open end, means for reciprocating the open end of said suction tube toward and away from the end of the stack of labels on the label support tray to continually pick the end label off the stack, label engaging means positioned adjacent said suction tube for contacting the label carried by said suction tube on opposite sides of said suction tube when the open end of the suction tube has been moved away from the stack of labels for urging the label away from the suction tube, control means for activating said air flow means when said suction tube is adjacent the end of the stack of labels and is moving away from the stack of labels and for deactivating said air flow means when said suction tube is positioned away from the stack of labels.

16. The apparatus for dispensing flat labels of claim 15 and wherein said label engaging means comprises a fork member including legs straddling said suction tube and each leg including a ledge movable across said suction tube for engaging the label carried by the suction tube on opposite sides of said suction tube.

17. The apparatus for dispensing flat labels of claim 15 and further comprising an inclined chute positioned beneath said suction tube for receiving labels from said suction tube, and belt conveyor means including a conveyor flight extending along said chute for moving labels down said chute to a work piece beneath said chute.

* * * * *